US007237975B2

(12) United States Patent
Noguchi

(10) Patent No.: US 7,237,975 B2
(45) Date of Patent: Jul. 3, 2007

(54) CARTRIDGE TYPE LIQUID FEEDING CONTAINER

(75) Inventor: Yoshio Noguchi, Kawagoe (JP)

(73) Assignee: Kotobuki Printing Co., Ltd., Kyoto-shi, Kyoto-Fu (JP)

( * ) Notice: Subject to any disclaimer, the term of this patent is extended or adjusted under 35 U.S.C. 154(b) by 334 days.

(21) Appl. No.: 10/896,016

(22) Filed: Jul. 22, 2004

(65) Prior Publication Data

US 2005/0158114 A1 Jul. 21, 2005

(30) Foreign Application Priority Data

Jan. 20, 2004 (JP) ..... 2004-012326

(51) Int. Cl.
*A46B 11/04* (2006.01)
*B05C 17/01* (2006.01)
*B43K 5/06* (2006.01)

(52) U.S. Cl. ..... 401/277; 401/270; 401/286; 401/173; 401/171

(58) Field of Classification Search ..... 401/171–175, 401/270, 274, 275, 277, 286
See application file for complete search history.

(56) References Cited

U.S. PATENT DOCUMENTS 2,632,193 A 3/1953 Gilchrist
3,002,517 A * 10/1961 Pitton ..... 401/172
3,359,992 A * 12/1967 Cishek et al. ..... 401/101
3,468,612 A 9/1969 Aston
4,599,008 A 7/1986 Furlong et al.
4,808,022 A * 2/1989 Iizuka et al. ..... 401/176
6,213,662 B1 * 4/2001 Aljanedi ..... 401/175
6,328,040 B1 12/2001 Stein
6,648,538 B2 * 11/2003 Gueret ..... 401/130

FOREIGN PATENT DOCUMENTS

JP 6-14844 4/1994
JP 2001-299442 10/2001

* cited by examiner

*Primary Examiner*—David J. Walczak
(74) *Attorney, Agent, or Firm*—McGinn IP Law Group, PLLC

(57) ABSTRACT

A cartridge type liquid feeding container is capable of being used by refilling or replacing a liquid instead of throwing away the container itself, and can feed out the liquid inside the cartridge.

The liquid feeding container includes a body, a manipulating body which is mounted movable with respect to the body and is made capable of being manipulated from an outside, a cartridge which is loaded into the body so as to be attachable and detachable, a liquid supplying body for supplying the liquid inside the tank portion to the outside, a piston rod which is workable on the piston to press the piston of the cartridge forward, and movable inside the cartridge case and body, and a conversion mechanism for converting a manipulating force applied to the manipulating body into forward movement of the piston rod.

8 Claims, 13 Drawing Sheets

CARTRIDGE TYPE LIQUID FEEDING CONTAINER

BACKGROUND OF THE INVENTION

1. Field of the Invention

The present invention relates to a cartridge type liquid feeding container having a cartridge for housing a liquid such as cosmetic ink, writing ink, correction liquid, etc, and capable of feeding out the liquid inside the cartridge.

2. Description of the Related Art

Conventionally, as a container housing a liquid of this kind and capable of feeding the liquid, there is the one described in, for example, Japanese Utility Model Publication No. 6-14844. The liquid container described in this Official Gazette is comprised of a barrel body in which a coating liquid storing portion is formed, a threaded bar projectingly provided at a piston slidably fitted in the storing portion, and a rotary cylinder integrally connecting an inner cylinder member and an outer cylinder member. The outer cylinder member has a ring protruded rib and an engaging claw capable of being resilient in an axial direction in a tip end portion of the outer cylinder so that the ring protruded rib is press-fitted into a ring groove at the rear end of the barrel body to rotatably connect the rotary cylinder to the barrel body, and the engaging claw of the outer cylinder member is elastically meshed with a ratchet tooth integrally formed in a circumferential direction in the barrel body to construct a ratchet mechanism. A threaded hole is provided in the inner cylinder member of the rotary cylinder to be screwed onto the threaded bar. Two plane portions formed on both sides over the entire length of the threaded bar are slidably fitted into a slide hole formed in a partition wall of the rear end of the storing portion of the barrel body, and the threaded bar is advanced without being rotated by the rotation of the rotary cylinder to press the piston in the axial direction to supply a coating liquid.

When the rotary cylinder is rotated with respect to the barrel body, relative rotation occurs between the inner cylinder member of the rotary cylinder and the threaded bar because the threaded bar is slidably fitted in the slide hole formed in the partition wall of the rear end portion of the storing portion of the barrel body, and the threaded bar advances by thread engagement between the threaded bar and the threaded hole of the rotary cylinder to press the piston in the axial direction to make it possible to supply a coating liquid to a tip end of the barrel body.

However, with the liquid container described in this Official Gazette, when the liquid stored in the coating liquid storing portion is used up, the liquid container itself cannot be reused, and is thrown away after only one use, which is a waste of resources. When the content of the liquid is desired to be replaced and used temporarily, there is no other way but to use another liquid container.

The liquid container described in Japanese Patent Laid-Open No. 2001-299442 has the same problems as Japanese Utility Model Publication No. 6-14844.

SUMMARY OF THE INVENTION

The present invention is made in view of the above problems, and its object is to provide a cartridge type liquid feeding container which is a cartridge type capable of being used by refilling or replacing the liquid instead of throwing away the container itself after only one use, and is capable of feeding out the liquid inside the cartridge. Another object of the present invention is to provide a cartridge type liquid feeding container which makes it possible to perform the operation easily when the liquid is refilled or replaced.

In order to achieve the object, a cartridge type liquid feeding container according to the present invention comprises a body, a manipulating body capable of being manipulated from an outside, a cartridge which is loaded into the body so as to be attachable and detachable, and has a cartridge case, a tank portion located inside the cartridge case for housing a liquid, and a piston which slidably moves in the tank portion, a liquid supplying body for supplying the liquid inside the tank portion to the outside, a piston rod which is workable on the piston to press the piston of the cartridge forward, and is movable inside the cartridge case and body, and a conversion mechanism for converting a manipulating force applied to the manipulating body into forward movement of the piston rod.

The conversion mechanism may be a thread engagement between the piston rod and the cartridge case, for screwing the piston rod into the cartridge case, and moving the piston rod forward by relative rotation between the manipulating body and the body.

The piston rod may be biased in a direction to go away from the cartridge, inside the body and the thread engagement may screw the piston rod into the cartridge case when the cartridge is located in a mounting position inside the body, whereas when the cartridge is out of the mounting position inside the body, the thread engagement may loosen the screwing of the piston rod and the cartridge case.

The thread engagement may comprise a male thread formed on an outer peripheral surface of the piston rod and a female thread provided on the cartridge case, the female thread may be capable of expanding and contracting in a radial direction, and when the female thread is located in the mounting position inside the body, the female thread may contract in a diameter and be screwed onto the male thread.

Preferably, the liquid supplying body may be separable from the body.

The liquid supplying body may be provided on a leading tool, the cartridge may be attachably and detachably connected to the leading tool, and the leading tool may be attachably and detachably mounted to the body.

According to the present invention, by manipulating the manipulating body, the conversion mechanism converts the manipulating force applied to the manipulating body into the forward movement of the piston rod, the piston rod works on the piston of the cartridge and moves inside the cartridge case and inside the body to press the piston forward. The piston slides in the tank portion to push the liquid inside the tank portion forward, and therefore the liquid can be supplied to the outside from the liquid supplying body. When the liquid inside the tank portion becomes scarce, the cartridge is removed from the body, and is replaced with a new cartridge, whereby the liquid can be supplied again. At this time, the piston rod is separable from the piston, and therefore the cartridge can be easily replaced.

In this manner, the body, the piston rod, and the manipulating body can be used continuously without being thrown away after only one use, and the resources can be utilized effectively.

On replacement of the cartridge, when the cartridge is removed from the mounting position inside the body, the screwing of the piston rod and the cartridge case is loosened, and thereby the cartridge can be released from the piston rod and easily removed. Then, the piston rod can be automatically returned to the position where the piston rod is separated from the cartridge.

If the liquid supplying body of the cartridge is replaced, different kinds of liquid can be supplied with the same liquid feeding container.

The present disclosure relates to subject manner contained in Japanese Patent Application No. 2004-12326, filed on Jan. 20, 2004, which is expressly incorporated herein by reference in its entirety.

DETAILED DESCRIPTION OF THE PREFERRED EMBODIMENTS

Hereinafter, an embodiment of the present invention will be explained by referring the drawings.

Figure 1:
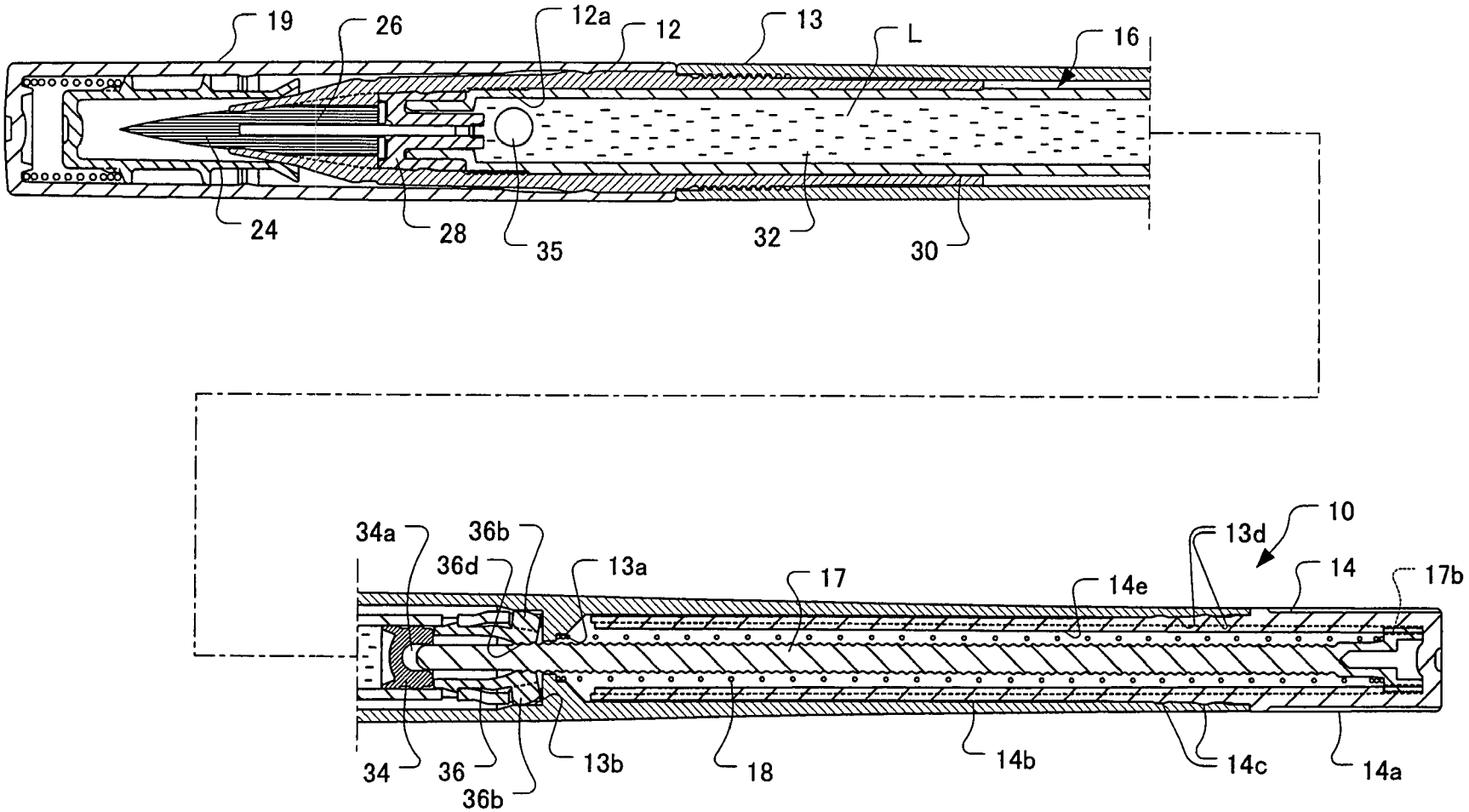
FIG. 1 is an overall longitudinal cross-sectional view showing a cartridge type liquid feeding container of a first embodiment of the present invention.
Figure 2:
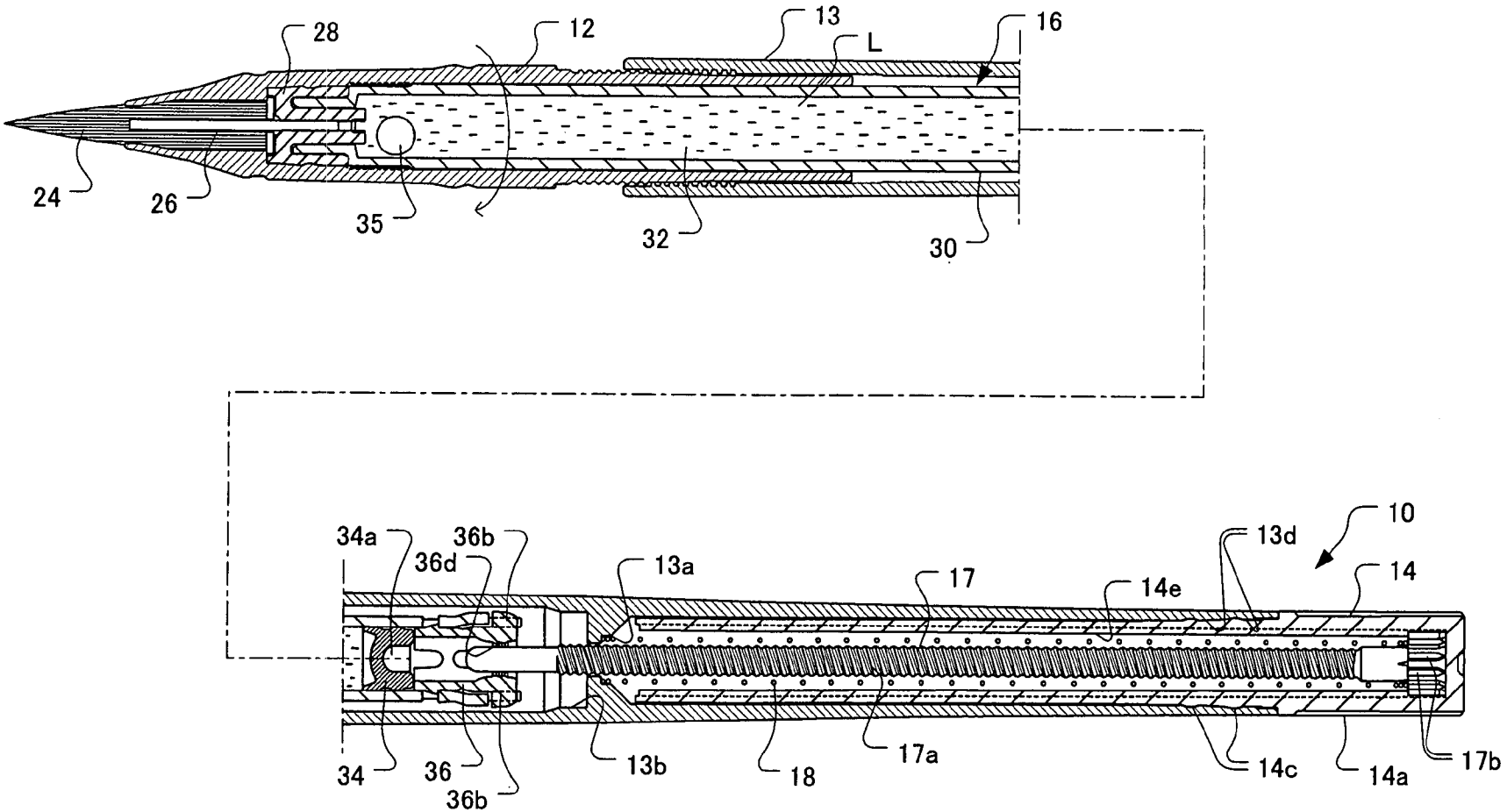
FIG. 2 is an overall longitudinal cross sectional view showing a state when a cartridge of the cartridge type liquid feeding container of the first embodiment is loaded.
Figure 3:
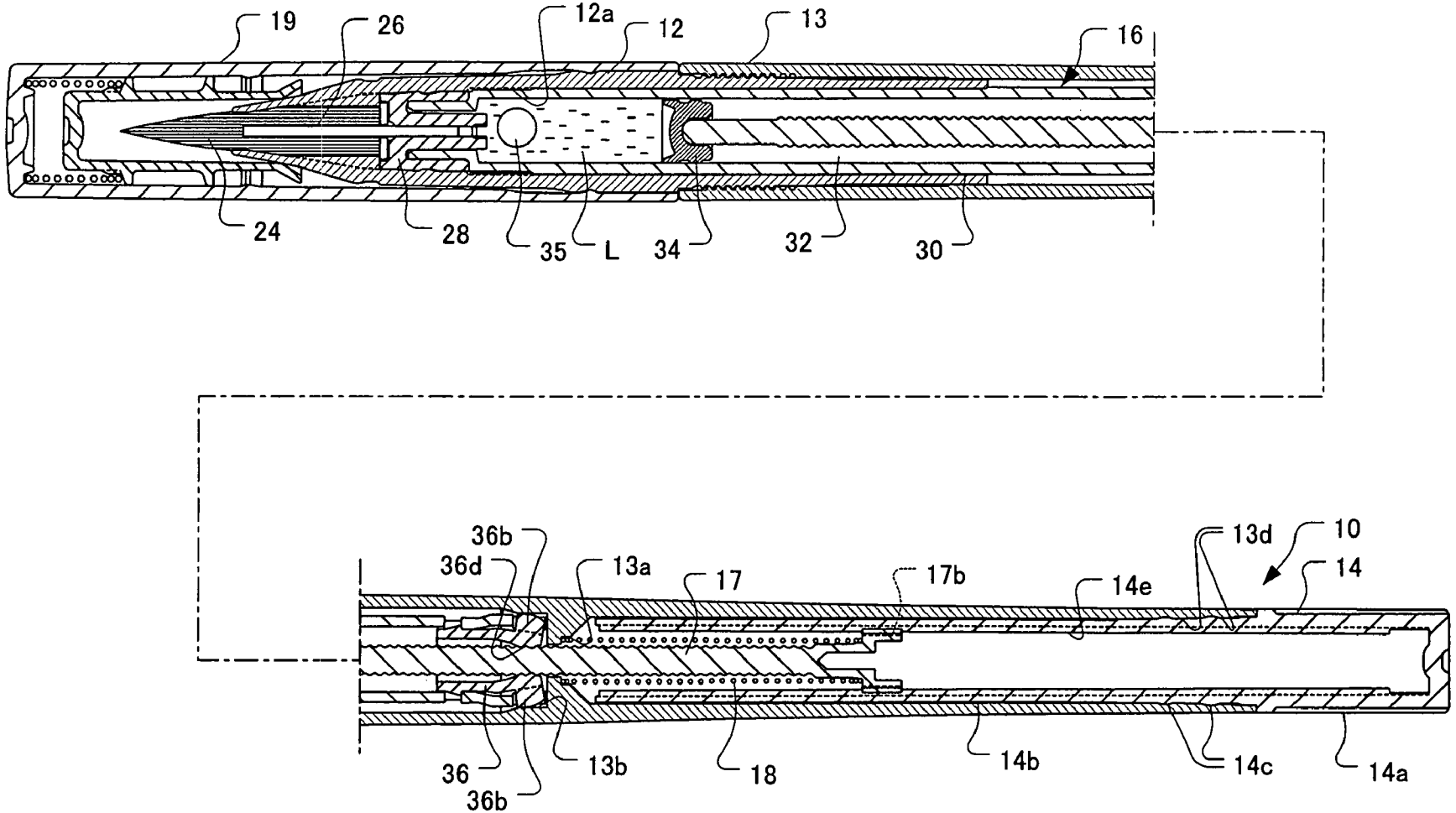
FIG. 3 is an overall longitudinal cross-sectional view showing a state in which a piston rod of the cartridge type liquid feeding container of the first embodiment moves forward.

FIG. 1 to FIG. 3 are views showing a cartridge type liquid feeding container of a first embodiment of the present invention.

In the drawings, a cartridge type liquid feeding container 10 generally has a leading tool 12 including a liquid supplying body, a body 13, a manipulating body 14, a cartridge 16, a piston rod 17, a spring 18 for biasing the piston rod 17 rearward and a cap 19.

The leading tool 12 is provided with a brush 24 which is a liquid supplying body for coating the liquid, a tip end pipe 26 for flowing the liquid to the brush 24, and a pipe holder 28 which is fixed inside the leading tool 12, and also fixes the brush 24 and a tip end pipe 26 to the leading tool 12. Further, on an inner peripheral surface of the leading tool 12, a plurality of longitudinal ribs 12*a* (see FIG. 1) extending in an axial direction are formed behind the pipe holder 28. However, instead of the longitudinal ribs 12*a*, the inner peripheral surface of the leading tool 12 may be in a polygonal shape.

A rear end portion of the leading tool 12 is inserted into a tip end portion of the body 13 and is screwed into the tip end portion of the body 13 to be attachable and detachable. After being screwed, the leading tool 12 and the body 13 are integrally connected. An annular step portion 13*a* expanded in an inner diameter direction is formed in a central portion inside the body 13, and the piston rod 17 penetrates through a center hole of the annular step portion 13*a*. A portion in the front from the annular step portion 13*a* inside the body 13 is a space into which the cartridge 16 is inserted. A portion just in front of the annular step portion 13*a* is a small diameter portion 13*b*, and the small diameter portion 13*b* has a smaller inner diameter than the portion on the front side from the small diameter portion 13*b*. An annular rib 13*d* is formed on an inner peripheral surface of the rear end portion of the body 13.

Figure 4A:
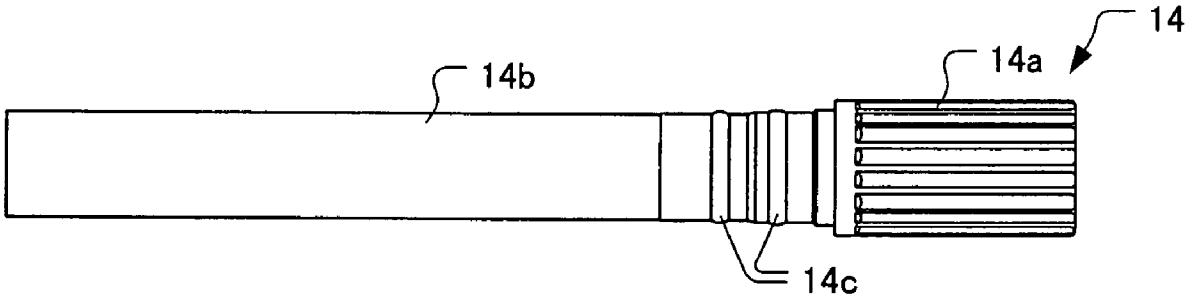
FIG. 4A is a plan view.
Figure 4B:
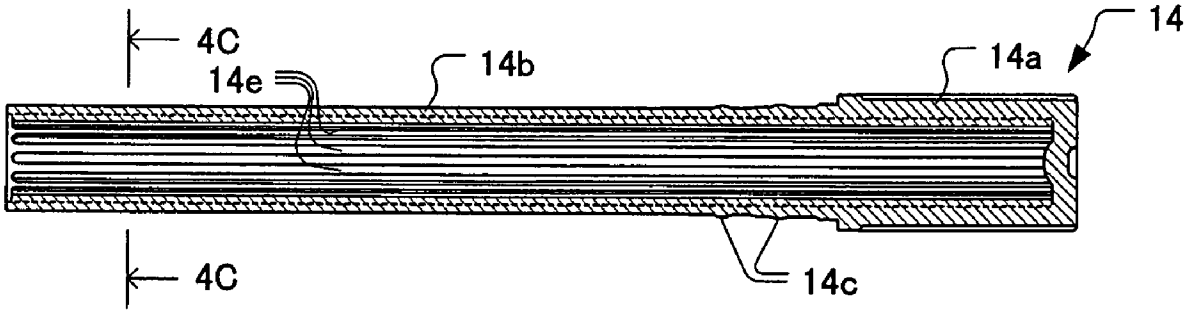
FIG. 4B is a longitudinal cross-sectional view of a manipulating body.
Figure 4C:
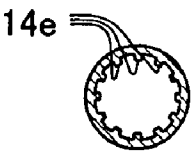
FIG. 4C is a sectional view taken along the c—c line in FIG. 4B.

A manipulating body 14 is mounted to a rear end portion of the body 13 to be capable of relatively rotating manipulation with respect to the body 13. Namely, as shown in FIGS. 4A, 4B and 4C, the manipulating body 14 is formed with a large diameter portion 14*a* and a small diameter portion 14*b*. An annular rib 14*c* is formed on an outer peripheral surface of the small diameter portion 14*b*, and the annular rib 14*c* is fitted in the annular rib 13*d*. A plurality of longitudinal ribs 14*e* extending in an axial direction are formed on an inner peripheral surface of the manipulating body 14.

Figure 5A:
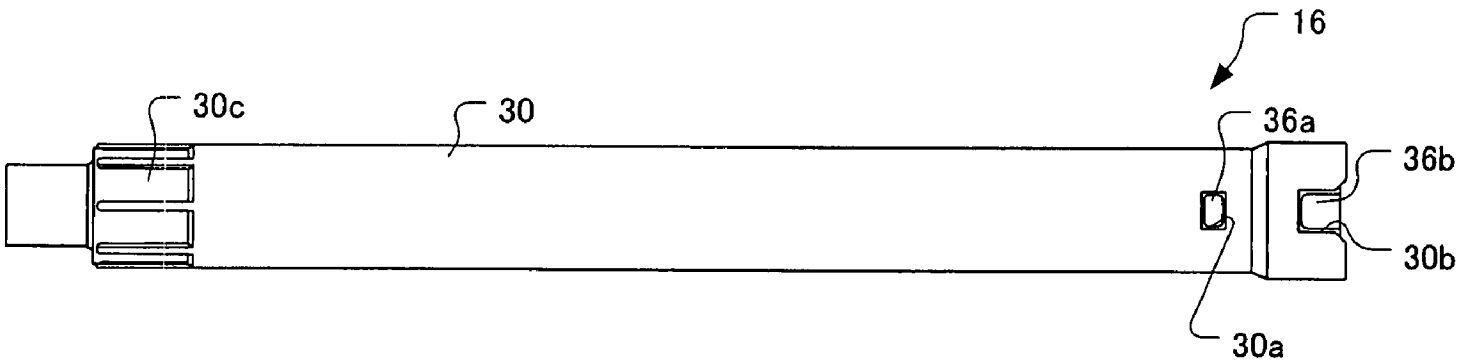
FIG. 5A is a plan view.
Figure 5B:
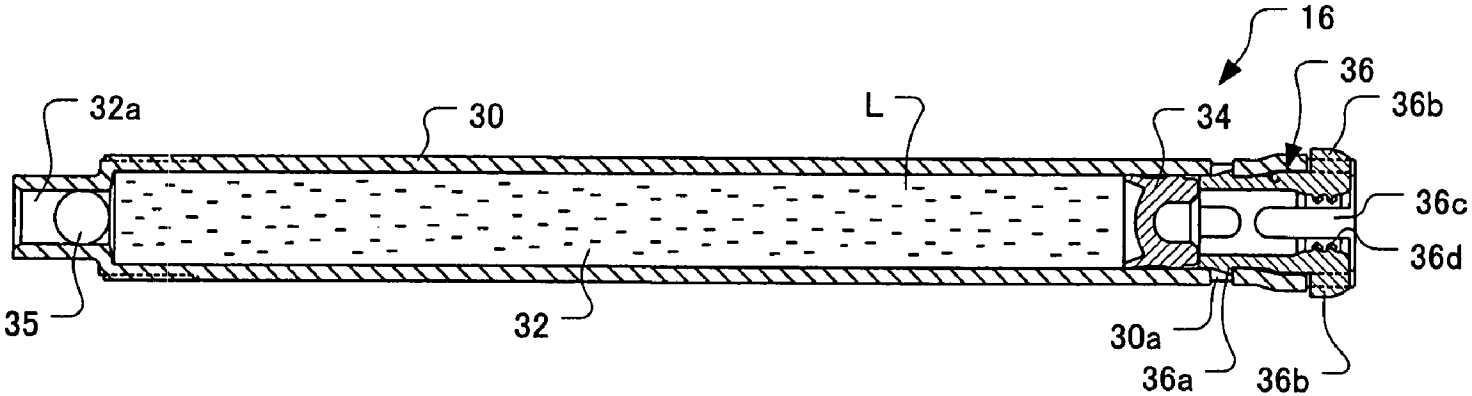
FIG. 5B is a longitudinal cross-sectional view of the cartridge.
Figure 6B:
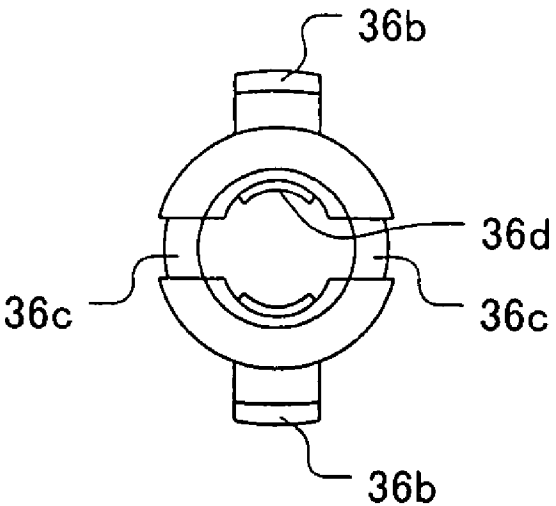
FIG. 6B is a view seen along the line 6B in FIG. 6A.
Figure 6A:
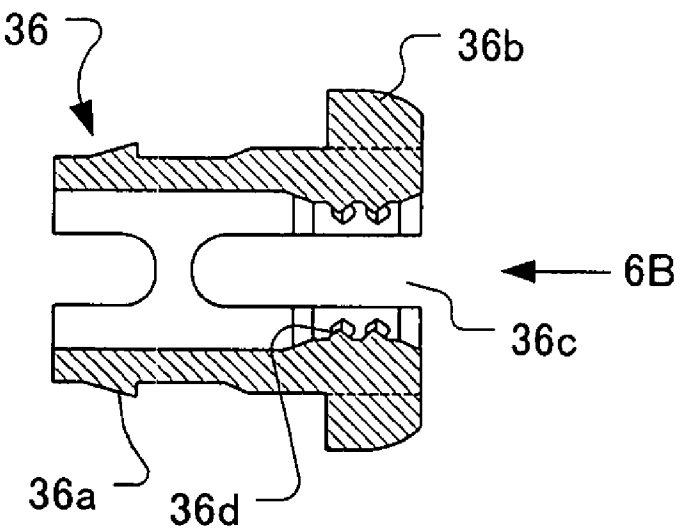
FIG. 6A is a longitudinal cross-sectional view of a chuck.

The cartridge 16 is attached into the body 13 so as to be attachable and detachable, and as shown in FIGS. 5A and 5B, the cartridge 16 has a cartridge case 30, a tank portion 32 defined inside the cartridge case 30 and housing the liquid, and a piston 34 which moves slidably in the tank portion 32 and serves as a bottom lid. A liquid L which is housed in the tank portion 32 can be, for example, a correction liquid, writing ink, cosmetic ink and the like, and the viscosity does not matter. A tip end of the cartridge case 30 is connected to the pipe holder 28, a tip end opening 32*a* of the tank portion 32 which is formed at a tip end of the cartridge case 30 communicates with the brush 24 via the pipe holder 28 and the tip end pipe 26. Longitudinal grooves 30*c* fitted on the longitudinal ribs 12*a* of the leading tool 12 are formed on an outer peripheral surface of the tip end portion of the cartridge case 30. Thus, the cartridge 16 rotates integrally with the leading tool 12. If the inner peripheral surface of the leading tool 12 is in a polygonal shape, the outer peripheral surface of the tip end portion of the cartridge case 30 should be formed into the polygonal shape fitted into the inner peripheral surface of the leading tool 12.

A tip plug 35 is enclosed in a tip end opening 32*a* of the tank portion 32 to prevent leakage of the liquid L when the viscosity of the liquid L is small in the unused state of the cartridge, and when the cartridge 16 is connected to the pipe holder 28 when used, the pipe holder 28 pushes the tip plug 35 into the tank portion 32 and opens the tip end opening 32*a*. However, when the viscosity of the liquid L is large, the tip plug 35 is not always needed, and instead of the tip plug 35, a cap for preventing the entrance of dust and the like may be provided. The tip plug 35 may be formed into any shape besides the spherical shape as shown in the drawing.

A chuck 36 is provided at a rear end of the cartridge case 30. The chuck 36 is a vertical chuck, and as shown in FIGS.

6A and 6B, its engaging protrusion 36*a* is engaged to an engaging hole 30*a* formed on an outer peripheral surface of the rear end portion of the cartridge case 30, and a pair of upper and lower protrusions 36*b* which are formed at the rear end of the chuck 36 and project in an outer diameter direction are fitted into a pair of upper and lower notches 30*b* formed at the rear end of the cartridge case 30. At the rear end of the chuck 36, notches 36*c* are formed in a portion where the protrusions 36*b* are not formed, and on an inner peripheral surface at the rear end of the chuck 36, a female thread 36*d* is formed in a portion where the notches 36*c* are not formed. As a result that the notches 36*c* are compressed, the female thread 36*d* of the chuck 36 is capable of reducing in the diameter in a radial direction.

Figure 7A:
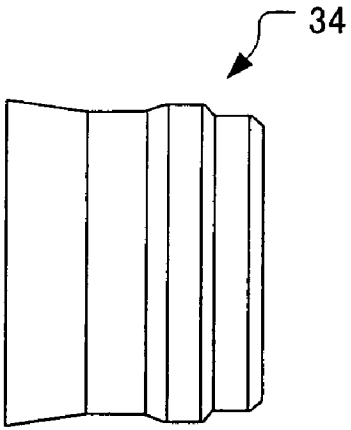
FIG. 7A is a plan view.
Figure 7B:
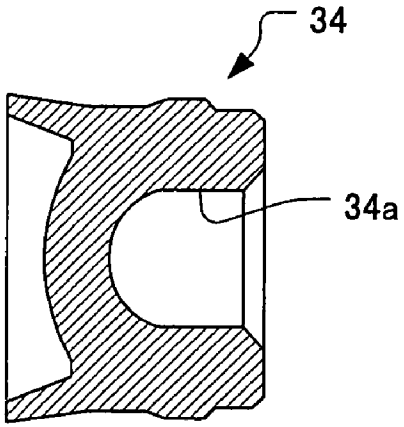
FIG. 7B is a longitudinal cross-sectional view of a piston.

The piston 34 is constructed by a material elastically in contact with the inner peripheral surface of the cartridge case 30, and as shown in FIGS. 7A and 7B, a receiving recessed portion 34*a* opened to the rear is formed at a rear end portion of the piston 34.

In the piston rod 17, its tip end portion is capable of being fitted into the receiving recessed portion 34*a* of the piston 34 to be attachable and detachable. A male thread 17*a* is formed on an outer peripheral surface of the piston rod 17. A plurality of longitudinal ribs 17*b* which are fitted in the longitudinal ribs 14*e* of the manipulating body 14 are formed at the rear end portion of the piton rod 17. Thus, the piston rod 17 rotates integrally with the manipulating body 14. The inner peripheral surface of the manipulating body 14 may be in the polygonal shape, and the outer peripheral surface of the rear end portion of the piston rod 17 may be in the polygonal shape fitted in the inner peripheral surface of the manipulating body 14.

The piston rod 17 and the chuck 36 provided at the cartridge case 30 are capable of being screwed, and a thread engagement of the male thread 17*a* of the piston rod 17 and the female thread 36*d* of the chuck 36 construct a conversion mechanism for moving the piston rod 17 forward. When the tip end portion of the piston rod 17 is fitted into the receiving recessed portion 34*a* of the piston 34, the tip end portion of the piston rod 17 is workable on the piston 34, and the forward moving force of the piston rod 17 can be transmitted to the piston 34. In this example, the piston rod 17 directly comes into contact with the piston 34 and is capable of pressing operation, but the present invention is not limited to this, and the piston 34 may be made capable of pressing operation via an additional member.

In the cartridge type liquid feeding container 10 constructed as above, the operation will be explained. First, the cartridge 16 is loaded into the body 13. Loading is performed by releasing the screwing of the body 13 and the leading tool 12, and after connecting the cartridge case 30 to the pipe holder 28 of the leading tool 12, inserting the cartridge 16 into the body 13 from the opening at the tip end of the body 13, which is opened, and screwing the leading tool 12 into the body 13 again (see FIG. 2). On the occasion of this screwing, the cartridge 16 is inserted until it abuts to the annular step portion 13*a* of the body 13 as the cartridge 16 is rotating with the leading tool 12. The chuck 36 provided at the cartridge case 30 is inserted into the small diameter portion 13*b* of the body 13, the protrusions 36*b* of the chuck 36 are pressed by the small diameter portion 13*b* and compress the notches 36*c* to reduce the inner diameter of the rear end portion of the chuck 36. While the chuck 36 is rotating, its female thread 36*d* is screwed into the male thread 17*a* of the piston rod 17.

When the cartridge type liquid feeding container 10 is used, the cap 19 is removed, and the liquid can be applied on a desired portion with the brush 24. When the amount of liquid supplied from the brush 24 becomes scarce, the manipulating body 14 is rotated in a predetermined direction with respect to the body 13. Then, the piston rod 17 integrally rotating with the manipulating body 14 rotates, and the cartridge 16 is integrated with the body 13, whereby the piston rod 17 screwed into the chuck 36 of the cartridge 16 moves forward inside the body 13. The tip end portion of the piston rod 17 is fitted into the receiving recessed portion 34*a* of the piston 34 to push the piston 34 forward, whereby the liquid L inside the tank portion 32 is pushed out to the brush 24 via the pipe holder 28, and is applied onto the surface to be coated from the brush 24.

In this manner, as the liquid is used, the piston rod 17 moves forward in the cartridge case 30 and in the body 13, and the piston 34 slides forward inside the tank portion 32 (see FIG. 3). When the liquid is used and the liquid inside the tank portion 32 becomes scarce, and it becomes necessary to replace the cartridge 16, screwing of the leading tool 12 and the body 13 is released again. When the leading tool 12 is rotated to release the screwing, the cartridge 16 also moves forward while rotating. At this time, the female thread 36*d* of the chuck 36 rotates with respect to the male thread 17*a* of the piston rod 17. However, when the protrusions 36*b* of the chuck 36 disengage from the small diameter portion 13*b*, the inner diameter of the rear end portion of the chuck 36 returns to the original natural state. Therefore, the female thread 36*d* is not screwed onto the male thread 17*a* any more, the screwing is loosened, the piston rod 17 is released from the cartridge 16, and therefore the piston rod 17 is returned rearward by the spring force of the spring 18 to return automatically to the initial state.

After the leading tool 12 and the body 13 are separated from each other, the old cartridge 16 is removed from the leading tool 12, then a new cartridge 16 is connected to the leading tool 12, and this new cartridge 16 is loaded into the body 13 again, whereby the new cartridge can be used similarly to the above. In this manner, the liquid can be refilled or replaced-without throwing away the components of the liquid feeding container 10 such as the leading tool 12, the body 13, the manipulating body 14 and the like other than the cartridge.

Not only the cartridge 16 but also the leading tool 12 can be replaced. For example, when the kind of the liquid is changed, the cartridge inclusive the leading tool 12 is replaced, whereby the leading tool 12 including the brush 24 can be replaced.

Figure 8:
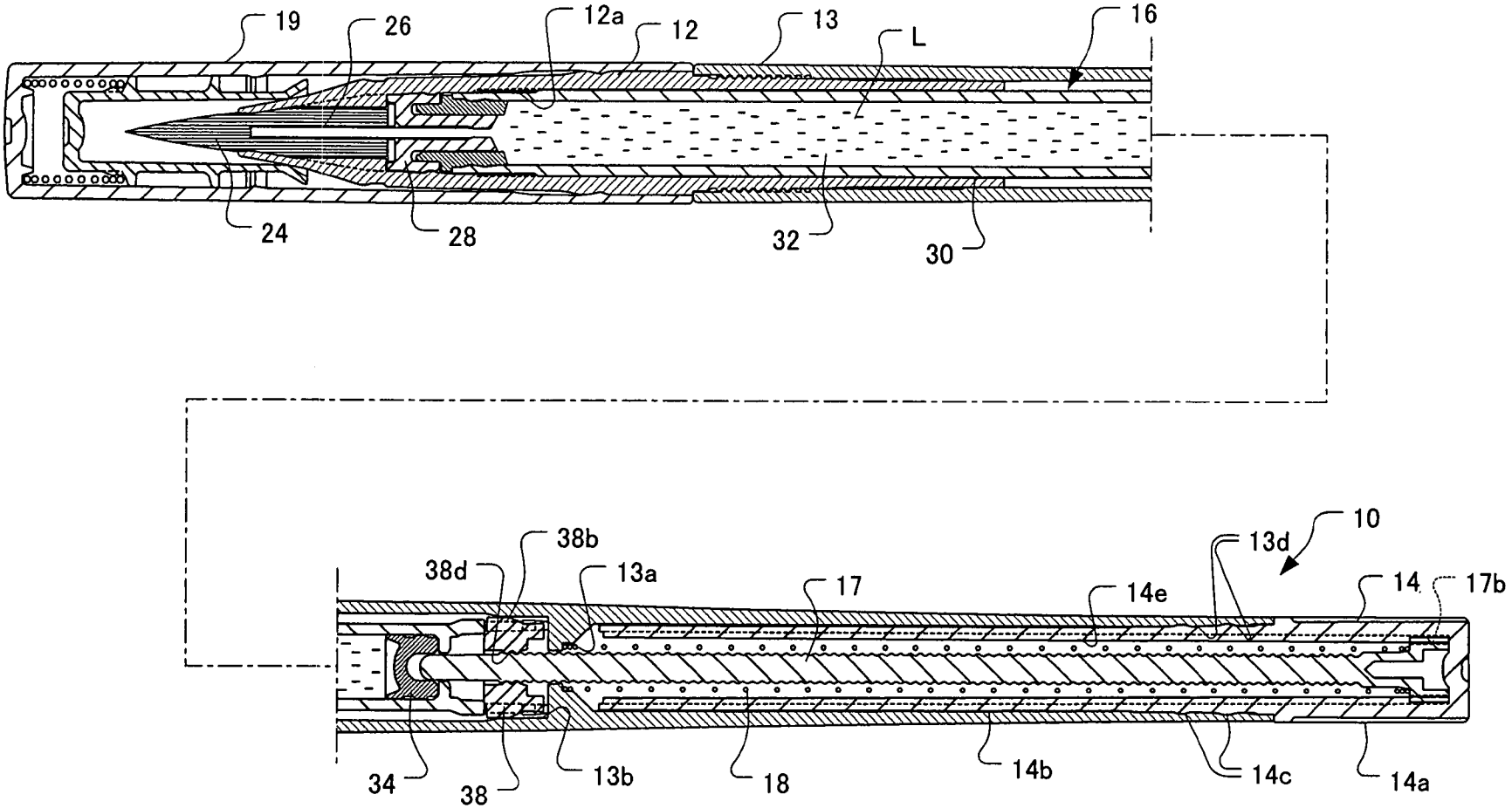
FIG. 8 is an overall longitudinal cross-sectional view showing a cartridge type liquid feeding container of a second embodiment of the present invention.

FIG. 8 is a view showing a second embodiment of the present invention. In the drawing, the same members as in the first embodiment are given the same reference numerals and characters, and the detailed explanation thereof will be omitted.

This embodiment differs from the first embodiment in the point that a C-type chuck is used in this embodiment instead of the vertical type chuck used as a chuck in the first embodiment, and in the other points than this, the second embodiment is approximately the same as the first embodiment.

As shown in FIGS. 10A and 10B and FIGS. 11A and 11B, a pair of upper and lower protrusions 38*b* formed at a rear end of the C-type chuck 38 to project in an outer diameter direction are fitted into a pair of upper and lower notches 30*b* formed at the rear end of the cartridge case 30 and locked. On the peripheral surface of the chuck 38, a slit 38*c* extending in the axial direction is formed in a portion where the protrusions 38*b* are not formed, and thus the cross-section of the chuck 38 is formed into the C-shape. On an inner peripheral surface of the rear end portion of the chuck 38, a female thread 38*d* is formed at a portion where the slit 38*c* is not formed. The slit 38*c* is compressed, whereby the female thread 38*d* of the chuck 38 is capable of being reduced in the diameter in the radial direction. The outline of the chuck 38 including the slit 38*c* is not limited to a circular shape, but may be an elliptical shape.

A thread engagement of the male thread 17*a* of the piston rod 17 and the female thread 38*d* of the chuck 38 constructs a conversion mechanism for advancing the piston rod 17.

Figure 9:
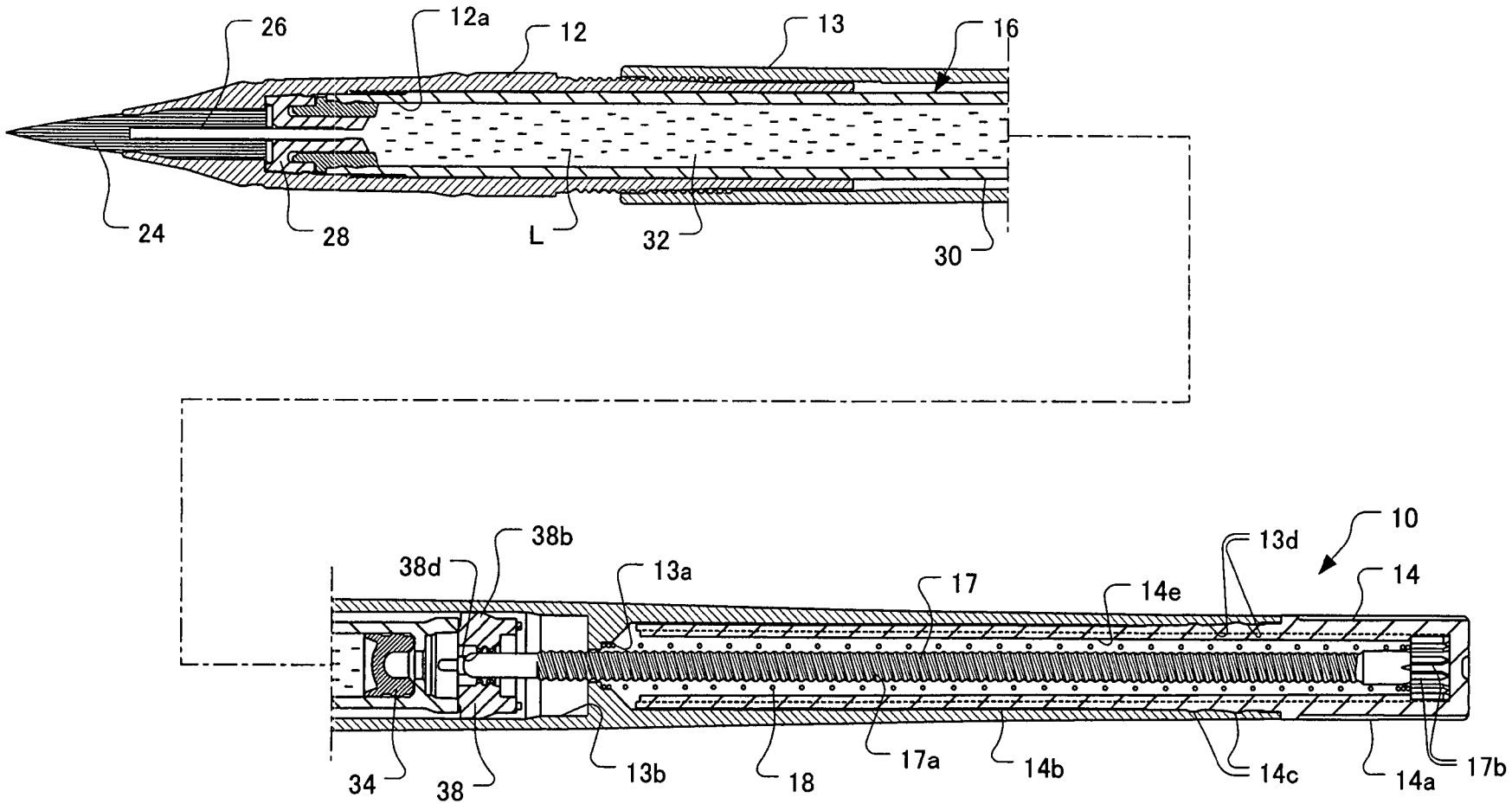
FIG. 9 is an overall longitudinal cross-sectional view showing a state when a cartridge of the cartridge type liquid feeding container of the second embodiment is loaded.
Figure 10A:
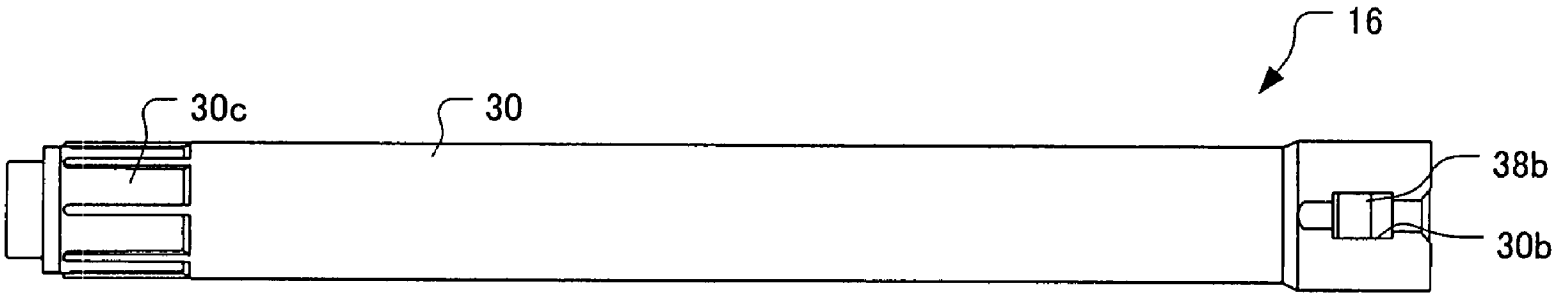
FIG. 10A is a plan view and FIG. 10B is a longitudinal cross-sectional view of the cartridge of the second embodiment.
Figure 10B:
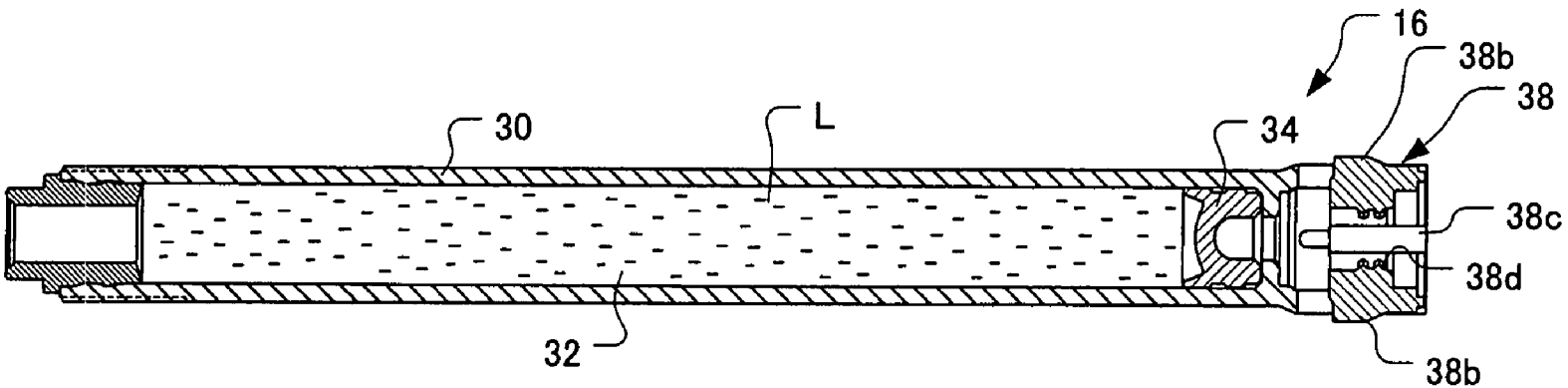
Figure 11B:
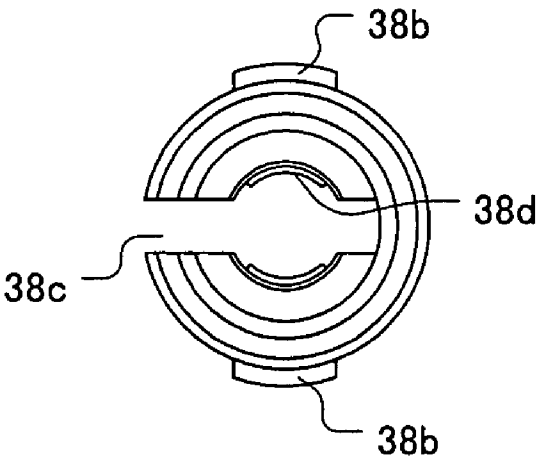
FIG. 11B is a view seen along the line 11B in FIG. 11A, of the second embodiment.
Figure 11A:
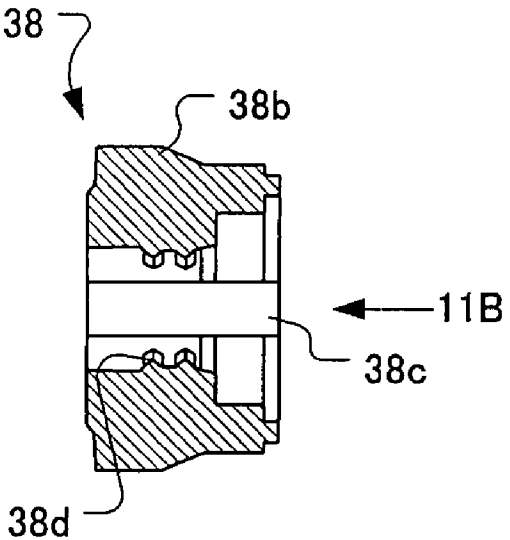
FIG. 11A is a longitudinal cross-sectional view of a chuck.

In the case of the cartridge 16 provided with such a chuck 38, when the cartridge 16 is loaded into the body 13 (see FIG. 9), the chuck 38 is inserted into the small diameter portion 13*b* of the body 13, the protrusions 38*b* of the chuck 38 are pressed by the small diameter portion 13*b* to compress the slit 38*c*, the inner diameter of the chuck 38 is reduced, and the female thread 38*d* is screwed onto the male thread 17*a* of the piston rod 17 while the chuck 38 is rotating (FIG. 8).

On the other hand, when it is necessary to replace the cartridge 16, then the screwing of the leading tool 12 and the body 13 is released, and the leading tool 12 is rotated, the cartridge 16 also moves forward while rotating. At this time, the female thread 38*d* of the chuck 38 is rotated with respect to the male thread 17*a* of the piston rod 17, but when the protrusions 38*b* of the chuck 38 are disengaged from the small diameter portion 13*b*, the inner diameter of the rear end portion of the chuck 36 returns into the original natural state, and therefore the female thread 38*d* is not screwed onto the male thread 17*a* any more, thus loosening the screwing, and releasing the piston rod 17 from the cartridge 16. Therefore, the piston rod 17 is returned rearward by the spring force of the spring 18 and automatically returns into the initial state.

Thus, the second embodiment can be operated similarly to the first embodiment.

Figure 12:
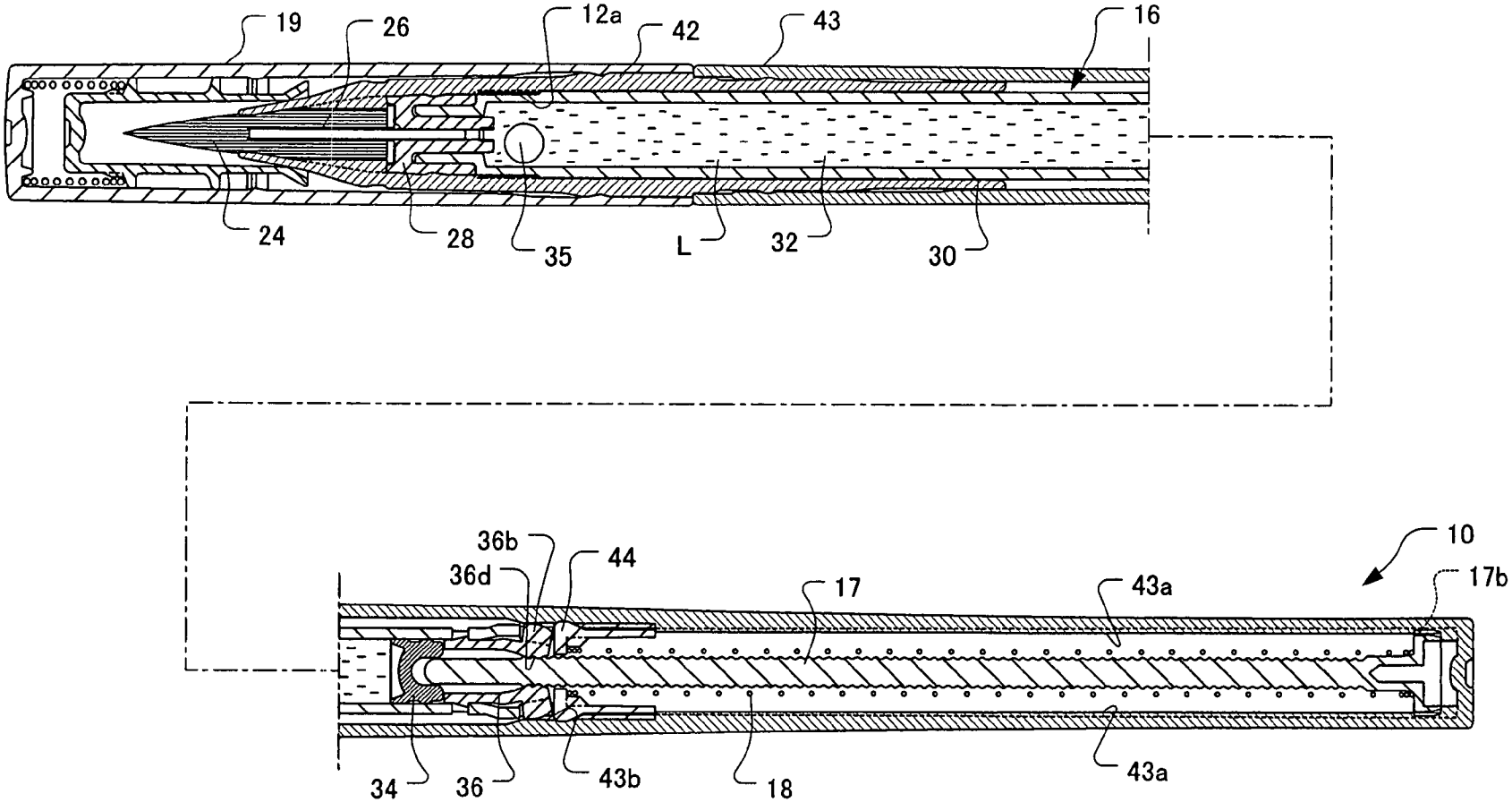
FIG. 12 is an overall longitudinal cross-sectional view of a cartridge type liquid feeding container of a third embodiment of the present invention.

FIG. 12 is a view showing a third embodiment of the present invention. In the drawing, the same members as in the first embodiment are given the same reference numerals and characters, and the detailed explanation will be omitted.

This embodiment differs from the previous embodiments in the point that the manipulating body is not mounted to the rear end portion of the body, but a leading tool 42 mounted to a tip end portion of a body 43 serves as the manipulating body.

Namely, the leading tool 42 is provided with the brush 24 as the liquid supplying body for coating the liquid, the tip end pipe 26 for flowing the liquid to the brush 24, the pipe holder 28 which is fixed inside the leading tool 42 and fixes the brush 24 and the tip end pipe 26 to the leading tool 42. Further, on an inner peripheral surface of the leading tool 42, a plurality of longitudinal ribs 12*a* (see FIG. 12) extending in the axial direction are formed at the rear from the pipe holder 28.

A rear end portion of the leading tool 42 is inserted into and fitted into a tip end portion of the body 43 to be attachable and detachable. After fitting, the leading tool 42 and the body 43 are connected to each other to be relatively rotatable. A stopper 44 is fixed in a central portion inside the body 43, and the piston rod 17 penetrates through a center hole of the stopper 44. A portion inside the body 43, which is in the front from the stopper 44 becomes the space into which the cartridge 16 is inserted. The portion of the body 43 just in front of the stopper 44 becomes a small diameter portion 43*b*, and the small diameter portion 43*b* has the smaller inner diameter than the portion on the front side from the small diameter portion 43*b*. At the rear portion from the stopper 44 of the body 43, a plurality of longitudinal ribs 43*a* extending in the axial direction are formed on its inner peripheral surface, the longitudinal ribs 17*b* are fitted in between the longitudinal ribs 43*a*, and thereby the piston rod 17 rotates integrally with the body 43. An inner peripheral surface inside the body 43 may be in the polygonal shape, and the rear end portion of the piston rod 17 may be in a polygonal shape fitted to this.

Figure 13:
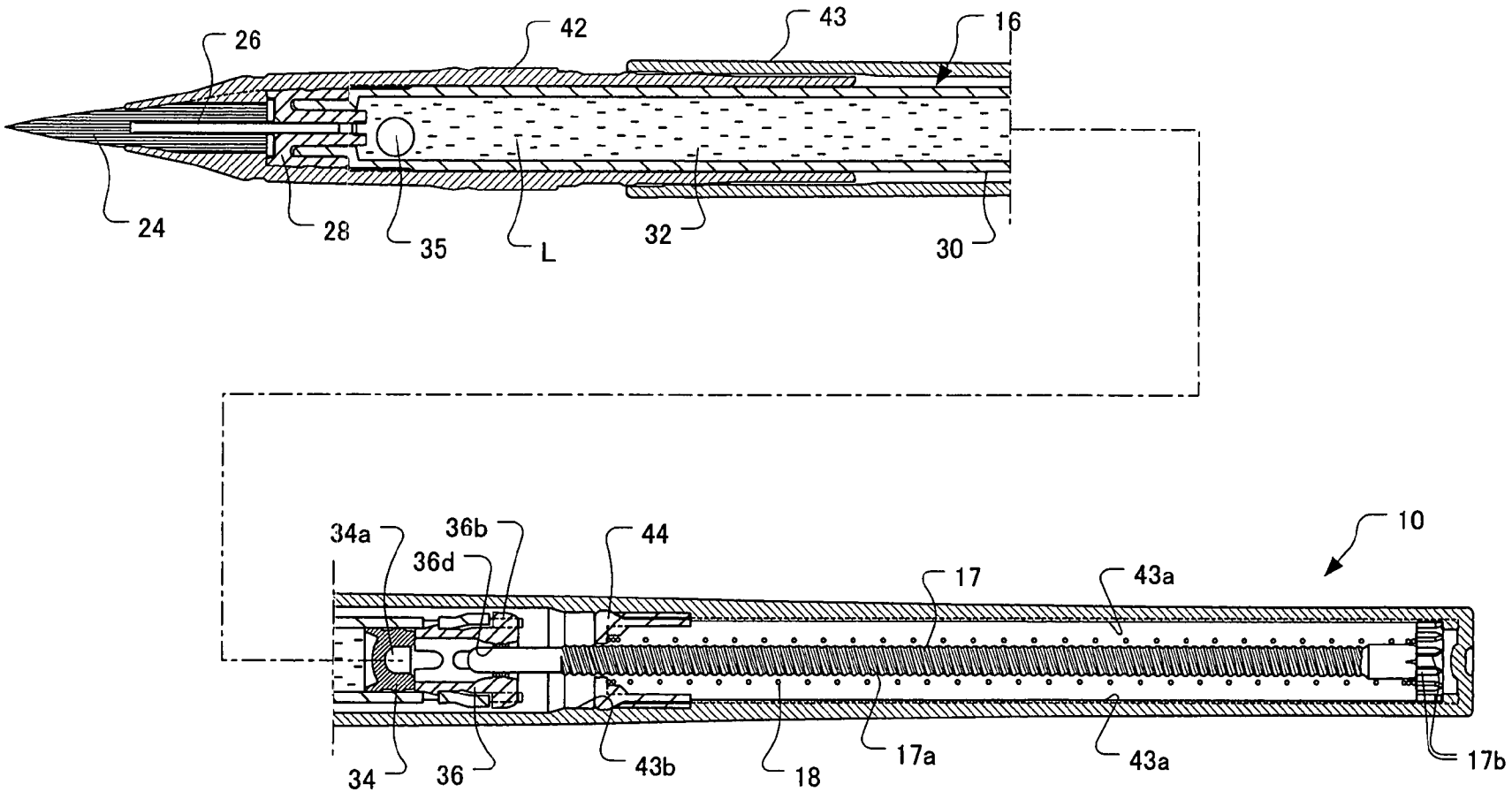
FIG. 13 is an overall longitudinal cross-sectional view showing a state when a cartridge of the cartridge type liquid feeding container of the third embodiment is loaded.

In the cartridge type liquid feeding container 10 constructed as above, an operation thereof will be explained. First, the cartridge 16 is loaded into the body 43. Loading is performed by releasing the connection of the body 43 and the leading tool 42, and after connecting the cartridge case 30 to the pipe holder 28 of the leading tool 42, inserting the cartridge 16 into the body 43 from the opening at the opened tip end of the body 43 and connecting the leading tool 42 to the body 43 again (see FIG. 13). At this time, the cartridge 16 is inserted until the cartridge 16 abuts to the stopper 44 fixed in the body 43. The chuck 36 provided on the cartridge case 30 is inserted into the small diameter portion 43*b* of the body 43, the protrusions 36*b* of the chuck 36 are pressed by the small diameter portion 43*b* to compress the notches 36*c* and the inner diameter of the rear end portion of the chuck 36 is reduced. The female thread 36*d* is screwed into the male thread 17*a* of the piston rod 17 while the leading tool 42 and the chuck 36 are being rotated.

When the cartridge type liquid feeding container 10 is used, the cap 19 is removed, and the liquid can be applied on a desired portion with the brush 24. When the liquid supplied from the brush 24 becomes scarce, the leading tool 42 is rotated in a predetermined direction with respect to the body 43. Then, the cartridge 16 which rotates integrally with the leading tool 42 rotates, while the piston rod 17 is incapable of rotating with respect to the body 43, and therefore the piston rod 17 moves forward inside the body 43 while being screwed into the chuck 36 of the cartridge 16. The tip end portion of the piston rod 17 is fitted into the receiving recessed portion 34*a* of the piston 34 to push out the piston 34 forward, and therefore the liquid inside the tank portion 32 is pushed out to the brush 24 via the pipe holder 28 to be coated on the surface to be coated from the brush 24.

In this manner, as the liquid is used, the piston rod 17 moves forward in the cartridge case 30 and the body 43, and the piston 34 slides forward in the tank portion 32. When the liquid is used up and the liquid inside the tank portion 32 has run out, and it is necessary to replace the cartridge 16, the connection of the leading tool 42 and the body 43 is released again. On releasing the connection, when the leading tool 42 is pulled out while rotating, the cartridge 16 also moves forward while rotating. At this time, the female screw 36*d* of the chuck 36 rotates with respect to the male screw 17*a* of the piston rod 17, but when the protrusions 36*b* of the chuck 36 disengage from the small diameter portion 43*b*, the inner diameter of the rear end portion of the chuck 36 returns to the original natural state. Therefore, the female thread 36*d* is not screwed onto the male thread 17*a*, screwing is loosened, the piston rod 17 is released from the cartridge 16, and therefore the piston rod 17 is returned rearward by the spring force of the spring 18 and automatically returns into the initial state.

After the leading tool 42 and the body 43 are separated from each other, the old cartridge 16 is disengaged from the leading tool 42, a new cartridge 16 is connected to the leading tool 42, and the new cartridge 16 is loaded into the body 43, whereby the liquid feeding container can be used similarly to the above. In this manner, the liquid can be refilled or replaced without throwing away the components of the liquid feeding container 10 such as the leading tool 42 and the body 43 other than the cartridge.

Not only the cartridge 16, but also the leading tool 42 can be replaced. For example, when the kind of the liquid is changed, if the leading tool 42 including the cartridge 16 is replaced, the leading tool 42 including the brush 24 can be replaced.

In each of the above embodiments, the member constructed by the single member can be constructed by a plurality of members, and the member constructed by a plurality of members can be constructed by a single member.

While the principles of the invention have been described above in connection with specific embodiments, and particular modifications thereof, it is to be clearly understood that this description is made only by way of example and not as a limitation on the scope of invention.

What is claimed is:

1. A cartridge type liquid feeding container, comprising:

a body;

a manipulating body capable of being manipulated from an outside;

a cartridge which is loaded into said body so as to be attachable and detachable, and has a cartridge case, a tank portion located inside the cartridge case for housing a liquid, and a piston which slidably moves in the tank portion;

a liquid supplying body for supplying the liquid inside the tank portion to the outside;

a piston rod which is workable on the piston to press the piston of said cartridge forward, and is movable inside said cartridge case and body; and a conversion mechanism for converting a manipulating force applied to said manipulating body into forward movement of the piston rod, wherein said conversion mechanism comprises a thread engagement between the piston rod and the cartridge case, for screwing the piston rod into the cartridge case, and moving the piston rod forward by relative rotation between the manipulating body and the body, and wherein said thread engagement between the piston rod and the cartridge case is detachable.

2. A cartridge type liquid feeding container, comprising:

a body;

a manipulating body capable of being manipulated from an outside:

a cartridge which is loaded into said body so as to be attachable and detachable, and has a cartridge case, a tank portion located inside the cartridge case for housing a liquid, and a piston which slidably moves in the tank portion;

a liquid supplying body for supplying the liquid inside the tank portion to the outside;

a piston rod which is workable on the piston to press the piston of said cartridge forward, and is movable inside said cartridge case and body; and a conversion mechanism for converting a manipulating force applied to said manipulating body into forward movement of the piston rod, wherein said conversion mechanism comprises a thread engagement between the piston rod and the cartridge case, for screwing the piston rod into the cartridge case, and moving the piston rod forward by relative rotation between the manipulating body and the body, wherein the piston rod is biased in a direction to go away from the cartridge, inside the body; and wherein said thread engagement screws the piston rod into the cartridge case when the cartridge is located in a mounting position inside the body, whereas when the cartridge is out of the mounting position inside the body, said thread engagement loosens the screwing of the piston rod and the cartridge case.

3. The cartridge type liquid feeding container according to claim 2, wherein said thread engagement comprises a male thread formed on an outer peripheral surface of said piston rod and a female thread provided on the cartridge case, the female thread is capable of expanding and contracting in a radial direction, and when the female thread is located in the mounting position inside the body, the female thread is contracted in a diameter and is screwed onto the male thread.

4. The cartridge type liquid feeding container according to claim 3, wherein said liquid supplying body is separable from said body.

5. The cartridge type liquid feeding container according to claim 1, wherein said liquid supplying body is separable from said body.

6. The cartridge type liquid feeding container according to claim 5, wherein said liquid supplying body is provided on a leading tool, and wherein the cartridge is attachably and detachably connected to the leading tool, and the leading tool is mounted to said body.

7. The cartridge type liquid feeding container according to claim 2, wherein said liquid supplying body is separable from said body.

8. The cartridge type liquid feeding container according to claim 7, wherein said liquid supplying body is provided on a leading tool, and wherein the cartridge is attachably and detachably connected to the leading tool, and the leading tool is mounted to said body.

* * * * *